United States Patent [19]

Palmer et al.

[11] Patent Number: 4,813,153

[45] Date of Patent: Mar. 21, 1989

[54] INK DRYING APPARATUS

[76] Inventors: Arthur R. Palmer; William K. Wright, both of Hillside House, Intwood Road, Cringleford, Norwich NR4 6TG, England

[21] Appl. No.: 913,563

[22] Filed: Sep. 29, 1986

Related U.S. Application Data

[63] Continuation-in-part of Ser. No. 705,322, Feb. 25, 1985, abandoned.

[51] Int. Cl.[4] ..... C10H 15/18

[52] U.S. Cl. ..... 34/48; 34/41

[58] Field of Search ..... 34/1, 4, 39, 41, 48; 118/641, 642, 643; 432/202

[56] References Cited

U.S. PATENT DOCUMENTS

| | | | |
|---|---|---|---|
| 2,559,713 | 7/1951 | Dunski et al. | 34/52 |
| 3,228,113 | 1/1966 | Fannon, Jr. | 34/39 |
| 4,501,072 | 2/1985 | Jacobi et al. | 34/1 |

*Primary Examiner*—Henry A. Bennet

*Attorney, Agent, or Firm*—Steven E. Kahm

[57] ABSTRACT

An ink drying machine for T-shirts and other articles which employs an array of ceramic heating tiles having flat surfaces to provide a large area of uniform intensity and wavelength radiation to the surface of T-shirts and other articles moving below the heating tiles on a conveyor belt. The array of heating tiles may consist of adjacent rows or have gaps between the rows. By having a variable speed conveyor belt the amount of radiation each T-shirt receives can be adjusted. The surface temperature of the tiles may be adjusted to provide different wave lengths for different inks. In this manner the intensity, wavelength and time of irradiation can be controlled. Since different inks have different drying requirements the machine can be adjusted to maximize production rates by varying the time and wave length of radiation the ink is exposed to.

14 Claims, 2 Drawing Sheets

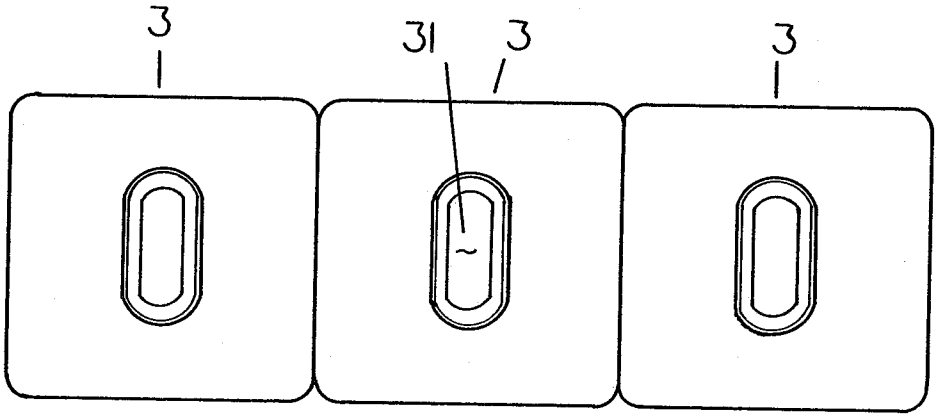
FIG. 3
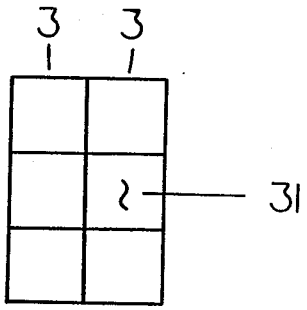
FIG. 4
FIG. 6
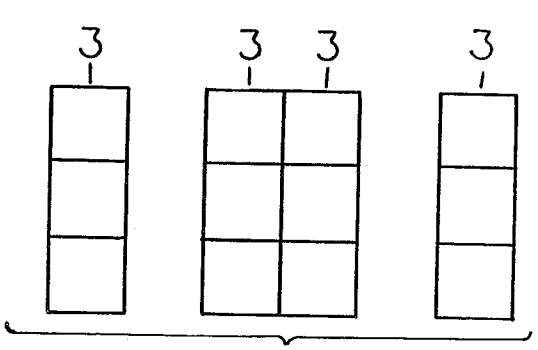
FIG. 7
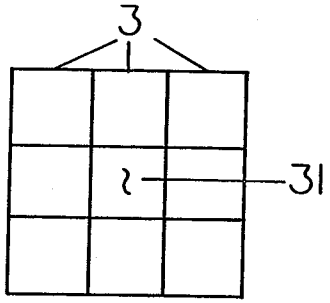
FIG. 5

INK DRYING APPARATUS

This is a continuation-in-part of application Ser. No. 705,322 filed 2/25/85, abandoned.

BACKGROUND

There are thousands of small T-shirt printing businesses that silk screen words and pictures on T-shirts and other articles.

These businesses generally use a silk screen process to print cloth with an ink. Then the ink must be dried.

There are many ink drying machines on the market. These machines use a heat source to evaporate the solvents in the ink. The heat sources are sometimes gas powered but are mostly electric heating elements, generally quartz rods, resistance rods or resistance wires of some type.

Most of these driers are large, heavy machines which are inefficient, expensive to operate and frequently require expensive shipping and installation charges.

What is needed is a small, efficient, economical T-shirt drying machine that uses a small amount of electricity and is highly reliable.

SUMMARY OF THE INVENTION

The present invention is a small light weight, reliable, efficient machine that will easily fit into a small T-shirt printing shop and can be installed by simply carrying it in, plugging it in and turning it on. No special wiring is required as this machine uses far less electricity than other machines and will operate on the standard electric service provided on a typical electric circuit.

The small size and economical use of electricity distinguishes this machine from its competition. The improved performance and smaller size are made possible by the use of ceramic heating tiles instead of standard heating elements.

The ceramic heating tiles have a flat surface which uniformly radiates heat over a large surface area. This allows for a larger surface area of the T-shirts to be irradiated at the same time with a like amount of radiation resulting in a quicker more efficient drying process, and results in higher production rates.

The ceramic heating tiles have two reflectors above them to reflect heat back toward the surface of the T-shirts. The high efficiency of the ceramic heating tiles allows for the economical use of electricity, lowering the electric bills of the user significantly. By using far less electricity the standard plugs and circuits in a building can be used eliminating the need for expensive rewiring as is required for other drying machines.

The lightness and small size of the drying machine is attributed to the compact lightweight and efficient heating tiles. This allows the machine to be easily moved and permits it to be used in a small space.

BRIEF DESCRIPTION OF THE DRAWINGS

FIG. 3. Shows the surface of the ceramic heating tiles.

FIG. 4. Shows an array of two rows of ceramic heating elements.

FIG. 5. Shows an array of three rows of ceramic heating elements.

FIG. 6. Shows an array of ceramic tile heating elements with gaps between the rows, having the pattern 2,1,1.

FIG. 7. Shows an array of ceramic tile heating elements with gaps between the rows, having the pattern 1,2,1.

DETAILED DESCRIPTION OF THE INVENTION

Figure 1:
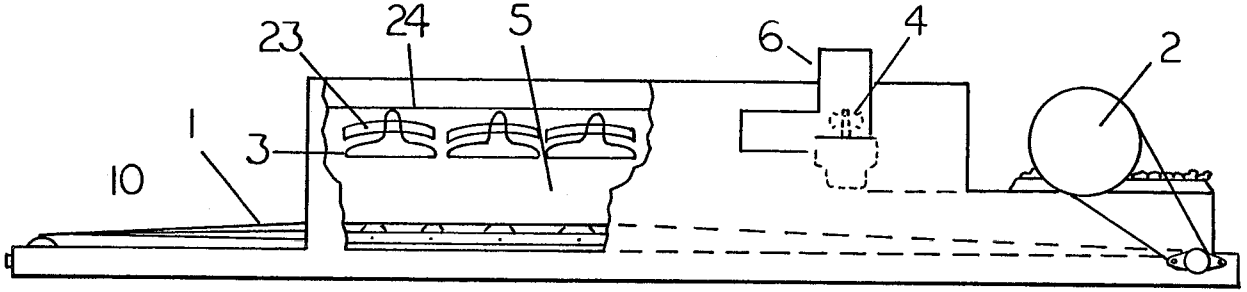
FIG. 1. A side view of the dryer with a three row array of heating tiles.

The machine is shown in general in FIG. 1 which shows a side view of one embodiment of the invention with its cover removed. It shows a conveyor belt 1, driven by a variable speed motor 2. It also shows three rows of ceramic heating tiles 3, and a fan 4.

A T-shirt is placed on the conveyor belt 1, at shelf area 10, which transports the T-shirt through the machine carrying it to the drying zone 5 which has an array of ceramic heating tiles 3, over it. The conveyor belt then carries the T-shirt out the back of the machine.

In the drying zone 5, the ceramic heating tiles irradiate the ink and surface of the T-shirt which dries the ink. The fan 4 draws cool air over the surface of the T-shirt and exhausts the vapors from the ink.

Figure 2:
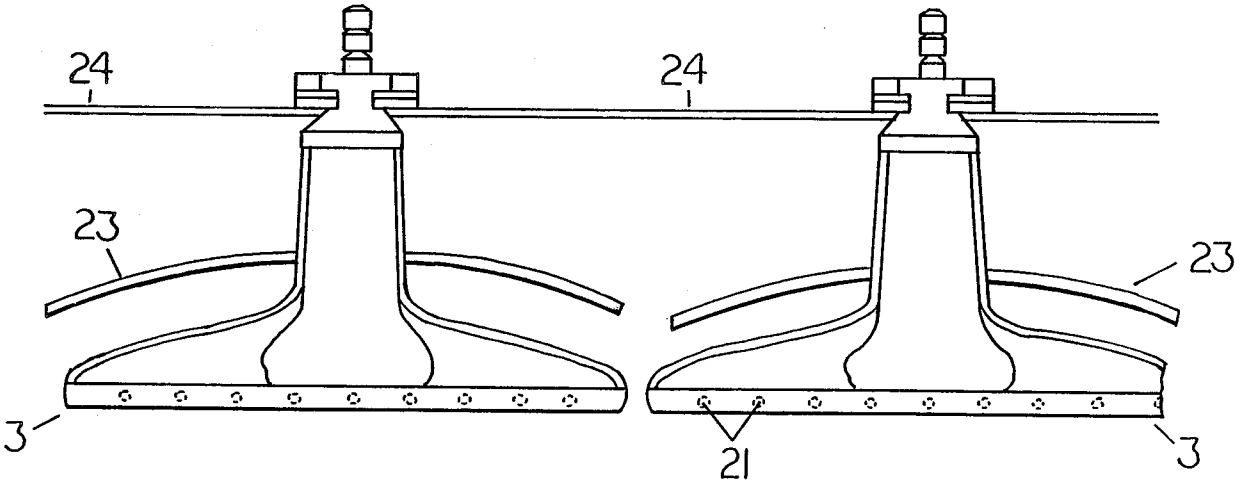
FIG. 2. Shows a cross section of the ceramic heating tiles.

The improvement in this design over the prior art consists of using a new type of ceramic heating element 3, (see FIGS. 2 and 3) which is a ceramic tile with a flat surface. The tile has electric resistance wires 21, running through it near the surface. The wires 21 heat the surface of the ceramic heating tiles creating a large area of uniform intensity radiation. The radiation therefrom is principly directed downward toward the surface of the T-Shirts. However some radiation will escape upwards to be reflected back downward by reflectors 23 and 24. Reflector 23 is placed immediately above the top surface of the ceramic heating tile 3 and reflector 24 is on the surface of the frame that the tiles are attached to.

The reflectors help reduce the heat loss from the tiles. Reflector 23 is placed close to the top surface of the ceramic heating tile 3, because infrared radiation is attenuated when absorbed by the air molecules they pass through. Therefore the closer the reflector to the radiation source the less air it has to pass through and less radiation is lost in heating air, thus making the system more efficient.

The heating tiles used are described in detail in U.S. Pat. No. 4,331,878 Stienmetz, however the insulation described in the patent is not used.

Since each ceramic heating tile is square, five inches on a side, an array of tiles must be used. The invention uses rows of three tiles per row to straddle the conveyor belt. Placing the tiles adjacent to one another provides a continuous even source of radiation across the span. Thus when the tiles are placed side by side a span of fifteen inches is reached. This is more than wide enough to irradiate the surface of the average T-shirt.

The advantages to using this ceramic heating tile are numerous. Conventional heat sources generally have a rod or other narrow source of heat. The radiation acts as if it were leaving a point source relative to the horizontal axis of a point on the conveyor belt, thus the radiation intensity increases as a T-shirt approaches the source of radiation and reaches a maximum directly beneath the radiation source and then decreases again as the t-shirt leaves the source of radiation. This creates a wide variation in the intensity of radiation received on the surface of the T-shirt and consequently varies the temperature on the surface of the T-shirt and of the ink.

By using the ceramic heating tiles with the flat surface the radiation is uniform over the surface of the tiles and consequently provides a more even supply of radiation to the surface of the ink and T-shirt as it travels beneath the ceramic heating tiles 3 on the conveyor belt 1. By using an array of ceramic heating tiles with two or three adjacent rows (see FIGS. 4 and 5 ), the drying zone 5, has respectively a ten or fifteen inch length and a 15 inch width of uniformly radiating tile surface above the conveyor belt. This has been found to be extremely beneficial in drying the ink on the T-shirts.

The inks used on T-shirts are of many types, some are water based and some have solvents which need to be evaporated. By experiment it was found that some types of inks dry quicker at a higher or lower wave length of infrared radiation and must be exposed to the radiation for different lengths of time.

By varying the temperature of the surface of the ceramic tiles a higher or lower wavelength radiation can be selected to more efficiently dry the desired type of ink. The ceramic tiles are adjusted in temperature by increasing or decreasing the supply of electricity to the resistance wires.

The ceramic tiles can be fitted with sensitive temperature sensors 31 (see FIG. 3), built into the surface of the tiles for accurately monitoring the temperature they radiate at. It is preferred to have one sensor in the middle tile of a three tile row for more accurate results and economy of sensors. In the two row array of FIG. 4 the sensor is placed in the rear row, center tile. In the three row array of FIG. 5 the sensor is in the middle row center tile. Each row consists of 3 adjacent ceramic heating tiles.

The conveyor belt 1, has a variable speed motor driving it for adjusting the speed the T-shirts pass under the ceramic tiles, thus adjusting the time duration of radiation at the selected wavelength the T-shirts will be exposed to.

Using this method of adjusting the wavelength and the time the ink is exposed to radiation of an even intensity an appropriate mix of time and radiation can be selected to maximize the drying process for the type of ink used.

This method has been found to be vastly superior to the prior art where the intensity and wave length of radiation is not controlled for set amounts of time.

Other advantages of using the ceramic heating tiles are that since they are more efficient than standard heating elements particularly with the reflectors behind them, there is a small amount of heat loss. Most of the energy generated is used to irradiate the ink on the T-shirts making the system extremely efficient compared to the prior art and results in the economic use of electricity for operating this unit.

By using far less electricity to dry the T-shirts the machine is able to be supplied by a standard service plug in the average building, eliminating the need for special and expensive wiring.

Another advantage of using the ceramic heating tiles is that they are lightweight and can generate the radiation needed to dry the ink in a small drying zone, therefore the drying machine can be made smaller and lighter than machines of similar capacity.

The ceramic heating tiles are also highly reliable lasting longer than other types of electric heating elements and they have a faster start up time which reduces down time when drying production is desired.

The fan 4, draws cool air over the surface of the T-shirts reducing the surface temperature which lowers the risk of the fabric scorching. The fan also draws off the vapors from the ink and exhausts them out of the work area by use of vent connection tube 6.

By removing the vapors from between the ceramic tile radiation source and the T-shirt there is less radiation blocked by the vapor, resulting a more efficient drying process. Removing the vapor also promotes drying by lowering the density of the vapor above the T-shirt surface allowing other molecules to evaporate.

A smaller fan is needed in this machine due to the high efficiency and low heat loss of the ceramic tiles. Most driers in the prior art describe the need to have larger fans to vent large amounts of wasted hot air and the need to cool the heating elements and surrounding areas.

By experiment it was found that using gaps between the rows of ceramic tile heating elements effected the drying times and production rates of the T-shirts. This was a surprising result. The inventors theorize that the first row of ceramic tile heating elements heat the surface of the T-shirts and ink to a high level, then the space provides it with an opportunity to cool slightly but since it is still very hot the ink is drying. By having a small gap, of about the width of a heating tile, the temperature does not drop much before the next row of tiles heats the surface of the T-shirts and ink again. The temperature may thus be maintained near the desired drying temperature. This process may be repeated one or more times until the ink is dry. FIG. 6 shows an array of rows of tiles with gaps between them using two rows of tiles, a gap, then one row of tiles, another gap and a last row of tiles. Any array of tiles may be used with different sized gaps for different inks as the need may be. By using the array of tiles with the gaps higher production rates, by as much as a 160%, have been achieved by increasing the conveyor belt speed with the input of a small amount of extra energy from an extra row of ceramic heating tiles. The gaps also provide an increased air circulation for a better drying environment. FIG. 7 shows one row of tiles a gap followed by two rows of tiles a gap and a last row of tiles. Many other arrays are possible.

It is has been preferred in the array of tiles with the gaps to have the first array of one or two rows of tiles set at a high temperature and to vary the other row or two rows of tiles in the array at a lower temperature setting.

Further experiments may dictate the varying of the temperatures row by row and varying the gaps between the rows of tiles for different results with different inks.

In a further embodiment the tiles may be arranged in an array of four wide instead of three wide as shown in the drawings for the above embodiments. The extra tile widens the drying zone so larger works may be dried. However since the user may not always need the larger size capacity to be used the last column in the rows of tiles in the array may be turned off to save electricity.

It is understood that any combination of arrays of tiles or tiles and gaps and temperature settings is covered by this invention and it is not limited to the specific combinations described above.

What is claimed is:

1. An ink drying machine for T-shirts comprising:

an array of ceramic heating tiles with at least one reflector above each heating tile, said array of ceramic heating tiles fixed above a variable speed conveyor belt, an array of ceramic infrared heating tiles each including a front portion having a radiating element with a substantially flat radiating surface, and a rear portion mounted to a support fixed above a conveyor belt; electrical conductors passing through said flat radiating surface; fastening means on the rear of each radiator and fastened to said support, with at least one reflector above each ceramic infrared heating tile, the array being fixed above a conveyor belt, a means to select various speeds for the conveyor belt, a fan for cooling the surface of the T-shirts and for exhausting vapor, a temperature sensor for measuring the temperature at the surface of a ceramic heating tile, said temperature sensor being built into the tile of at least one ceramic infrared heating tile, a thermostat and a means for setting and maintaining a certain temperature on the surface of the ceramic heating tiles.

2. An ink drying machine for T-shirts as in claim 1 where: the array of ceramic infrared heating tiles consists of two adjacent rows of tiles.

3. An ink drying machine for T-shirts as in claim 1 where: the array of ceramic infrared heating tiles consists of three adjacent rows of tiles.

4. An ink drying machine for T-shirts as in claim 1 where: the array of ceramic infrared heating tiles has gaps between the rows of ceramic heating tiles, the gaps spaced so as to increase the rate of drying.

5. An ink drying machine for T-shirts as in claim 4 where the rows in the array of ceramic infrared heating tiles may be set at different temperatures.

6. An ink drying machine for T-shirts comprising:

an array of hollow ceramic infrared heating tiles each including a front portion having a radiating element with a substantially flat radiating surface, and a rear portion mounted to a support fixed above a conveyor belt, said front portion having also a substantially conical section and a hollow space between said conical section and said flat radiating surface; electrical conductors passing through said hollow interiors of the radiators and through said radiating element with said flat radiating surface; said conical section being joined to said radiating element with said flat radiating surface; fastening means on the rear of each radiator and fastened to said support, a thermally insulating material filling the hollow interior of the radiators, with at least one reflector above each ceramic infrared heating tile, the array being fixed above a conveyor belt a means to select various speeds for the conveyor belt, a fan for cooling the surface of the T-shirts and for exhausting vapor, a temperature sensor for measuring the temperature at the surface of a ceramic heating tile, said temperature sensor being built into the tile of at least one ceramic infrared heating tile, a thermostat and a means for setting and maintaining a certain temperature on the surface of the ceramic heating tiles.

7. An ink drying machine for T-shirts as in claim 6 where: the array of ceramic infrared heating tiles consists of two adjacent rows of tiles with three adjacent ceramic heating tiles in each row.

8. An ink drying machine for T-shirts as in claim 6 where: the array of ceramic infrared heating tiles consists of three adjacent rows of tiles with three adjacent ceramic heating tiles in each row.

9. An ink drying machine for T-shirts as in claim 6 where: the array of ceramic infrared heating tiles has rows of ceramic heating tiles with gaps between the rows, the gaps being spaced so as to increase the rate of drying.

10. An ink drying machine for T-shirts as in claim 9 where the rows in the array of ceramic infrared heating tiles have a means of being set at different temperatures.

11. An ink drying machine for T-shirts as in claim 6 where: the array of ceramic infrared heating tiles consists of a row of ceramic heating tiles, a gap, then two adjacent rows of ceramic heating tiles, a gap, and a row of ceramic heating tiles, the gaps spaced so as to increase the rate of drying.

12. An ink drying machine for T-shirts as in claim 11 where the rows in the array of ceramic infrared heating tiles have a means of being set at different temperatures.

13. An ink drying machine for T-shirts as in claim 6 where: the array of ceramic infrared heating tiles consists of two adjacent rows of ceramic heating tiles, a gap, one row of ceramic heating tiles, a gap, and a row of ceramic heating tiles, the gaps spaced so as to increase the rate of drying.

14. An ink drying machine for T-shirts as in claim 13 where the rows in the array of ceramic infrared heating tiles have a means of being set at different temperatures.

* * * * *